US009128395B2

(12) United States Patent
Nosella et al.

(10) Patent No.: US 9,128,395 B2
(45) Date of Patent: Sep. 8, 2015

(54) HYBRID EMULSION AGGREGATE TONER

(71) Applicant: XEROX CORPORATION, Norwalk, CT (US)

(72) Inventors: Kimberly D. Nosella, Mississauga (CA); Guerino G. Sacripante, Oakville (CA); Richard P. N. Veregin, Mississauga (CA); Edward G. Zwartz, Mississauga (CA); David J. W. Lawton, Stoney Creek (CA)

(73) Assignee: XEROX CORPORATION, Norwalk, CT (US)

( * ) Notice: Subject to any disclaimer, the term of this patent is extended or adjusted under 35 U.S.C. 154(b) by 12 days.

(21) Appl. No.: 14/161,547

(22) Filed: Jan. 22, 2014

(65) Prior Publication Data

US 2015/0118610 A1 Apr. 30, 2015

Related U.S. Application Data

(63) Continuation-in-part of application No. 14/066,254, filed on Oct. 29, 2013.

(51) Int. Cl.

| | |
|---|---|
| ***G03G 9/08*** | (2006.01) |
| ***G03G 9/087*** | (2006.01) |
| ***G03G 9/093*** | (2006.01) |

(52) U.S. Cl.

CPC ..... *G03G 9/0808* (2013.01); *G03G 9/0825* (2013.01); *G03G 9/08711* (2013.01); *G03G 9/08755* (2013.01); *G03G 9/0935* (2013.01); *G03G 9/09392* (2013.01)

(58) Field of Classification Search

CPC ..... G03G 9/0935; G03G 9/09392; G03G 9/08711; G03G 9/08755

USPC ..... 430/109.3, 109.4, 137.11, 110.2

See application file for complete search history.

(56) References Cited

U.S. PATENT DOCUMENTS

| | | | |
|---|---|---|---|
| 4,295,990 | A | 10/1981 | Verbeek et al. |
| 4,457,998 | A | 7/1984 | Gruber et al. |
| 4,935,326 | A | 6/1990 | Creatura et al. |
| 4,937,166 | A | 6/1990 | Creatura et al. |
| 5,290,654 | A | 3/1994 | Sacripante et al. |
| 5,302,486 | A | 4/1994 | Patel et al. |
| 5,345,797 | A | 9/1994 | Hayes |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,556,732 | A | 9/1996 | Chow |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |

(Continued)

*Primary Examiner* — Mark A Chapman

(74) *Attorney, Agent, or Firm* — Pillsbury Winthrop Shaw Pittman LLP

(57) ABSTRACT

Toners and processes useful in providing toners suitable for electrophotographic apparatuses, including apparatuses such as digital, image-on-image, and similar apparatuses. In particular, emulsion aggregate toner compositions that use two different emulsion aggregation (EA) technologies and which comprise a base resin composed of both styrene-acrylate and polyester resins. These toner compositions further include polyaluminum chloride (PAC) instead of the more commonly used aluminum sulfate as the flocculant or aggregating agent.

17 Claims, 2 Drawing Sheets

(56) References Cited

U.S. PATENT DOCUMENTS

| | | | |
|---|---|---|---|
| 6,042,981 | A | 3/2000 | Barbetta et al. |
| 6,063,827 | A | 5/2000 | Sacripante et al. |
| 6,355,391 | B1 | 3/2002 | Van Dusen et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,014,971 | B2 | 3/2006 | Skorokhod et al. |
| 7,524,602 | B2 | 4/2009 | Vanbesien et al. |
| 8,466,254 | B2 | 6/2013 | Sacripante |
| 2009/0305159 | A1* | 12/2009 | Zhou et al. ..... 430/110.2 |

* cited by examiner

HYBRID EMULSION AGGREGATE TONER

RELATED APPLICATIONS

This application is a Continuation-in-Part of U.S. application Ser. No. 14/066,254, filed Oct. 29, 2013, which is expressly incorporated by reference.

BACKGROUND

The present disclosure relates to toners and processes useful in providing toners suitable for electrophotographic apparatuses, including apparatuses such as digital, image-on-image, and similar apparatuses. In particular, the disclosure relates to emulsion aggregate toner compositions that use two different emulsion aggregation (EA) technologies. Namely, the present embodiments provide an emulsion aggregation toner that comprises a base resin composed of both styrene-acrylate and polyester resins. These embodiments comprise polyaluminum chloride (PAC) instead of the more commonly used aluminum sulfate as the flocculant or aggregating agent. Toners made in this manner exhibit improved surface morphology and achieved improved toner blocking and percent heat cohesion, particularly for black toner. Further, such hybrid emulsion aggregation toner compositions are lower in cost but still maintain desirable developer properties like low minimum fusing temperature (MFT) and lower dielectric loss.

Numerous processes are within the purview of those skilled in the art for the preparation of toners. Emulsion aggregation is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

Emulsion aggregation toners may comprise various resins for use in forming the latex. One type of emulsion aggregation toner provides high gloss and uses styrene-acrylate, a lower costing resin. Another type of emulsion aggregation toner provides better fusing performance (e.g., lower Minimum Fix Temperature (MFT) of about 20° C.) and uses polyesters as the base resin. However, the polyester resins used are high in cost. Thus, the present embodiments seek to form a hybrid emulsion aggregation toner that combines the advantages from both types of toners. However, it was discovered that toners with styrene-acrylate latexes do not melt at the same temperature during the toner process as the polyester toners, thus leading to variation in the surface morphology in a hybrid of the two toner types (more polystyrene/acrylate remains on the surface). The present embodiments replace some of the polyester resin used in the core of the lower fusing toner with some of the styrene-acrylate of the high gloss toner and includes PAC as the aggregating agent. Such a hybrid composition provides a lower costing toner that retains good fusing performance and low dielectric loss. Moreover, the PAC unexpectedly improves the surface morphology by reducing the amount of styrene-acrylate on the surface.

SUMMARY

The present embodiments provide a toner composition a toner composition comprising: toner particles having a core, wherein the core comprises a resin, a colorant, a wax, and polyaluminum chloride, wherein the resin comprises a styrene-acrylate resin, a crystalline polyester resin and an amorphous polyester resin; and a shell disposed over the core.

In specific embodiments, there is provided a toner composition a developer comprising: a toner composition; and a toner carrier, wherein the toner composition comprises toner particles having a core, wherein the core comprises a resin, a colorant, a wax, and polyaluminum chloride, wherein the resin comprises a styrene-acrylate resin, a crystalline polyester resin and an amorphous polyester resin; and a shell disposed over the core.

In yet other embodiments, there is provided a developer comprising a method of making a toner comprising mixing together and emulsifying a resin, a colorant, and a wax, wherein the resin comprises a styrene-acrylate resin, a crystalline polyester resin to form a latex emulsion; adding polyaluminum chloride to the latex emulsion; aggregating the latex emulsion to form toner particle cores, wherein the toner particle cores comprise the styrene-acrylate resin, the crystalline polyester resin and the amorphous polyester; forming a shell over the toner particle cores to form toner particles; coalescing the toner particles; and cooling the toner particles.

BRIEF DESCRIPTION OF THE DRAWINGS

For a better understanding of the present embodiments, reference may be had to the accompanying figures.

DETAILED DESCRIPTION

Figure 1A:
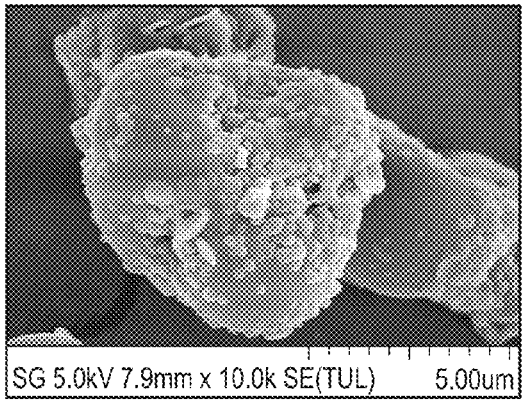
FIG. 1A provides scanning electron microscope (SEM) images of comparative polyester-based toner particles.

As discussed above, the present embodiments provide a hybrid emulsion aggregation (EA) toner where a conventionally polyester particle core is replaced with a portion of styrene-acrylate resin. Thus, the novel toner composition has styrene acrylate in the core as well as crystalline and amorphous polyester resins in the core. These resins are used to form the latex emulsion and ultimately get incorporated into the resulting particle core. The toner particle shell comprises polyester resin, and specifically, crystalline polyester resin. The styrene-acrylate resin is a lower costing resin as compared to the polyester resin used and thus reduces the overall cost of producing the toner while still achieving good fusing performance, dielectric loss, charging, blocking and percent cohesion. In addition, the present toner embodiments include polyaluminum chloride (PAC) as the aggregating agent. It was discovered that the PAC unexpectedly improves the surface morphology by reducing the amount of styrene-acrylate on the surface.

In embodiments, the styrene-acrylate resin is present in the toner particle core in an amount of from about 5 to about 35, or from about 10 to about 35, or from about 20 to about 35 percent by weight of the total weight of the core. In embodiments, the particle size of the styrene-acrylate emulsion is from about 100 nm to about 160 nm, or from about 100 nm to about 140 nm. It was discovered that use of styrene-acrylate resin in this range together with PAC provided optimum results in EA toner with good performance and properties and improved surface morphology.

In embodiments, the resins may be a polyester resin, such as, an amorphous resin, a crystalline resin, and/or a combination thereof, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the crystalline polyester resins is present in the toner particle core in an amount of from about 1 to about 20, or from about 1 to about 15, or from about 3 to about 10 percent by weight of the total weight of the core. In embodiments, the crystalline polyester resin used in the core is selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) to further reduce cost. Preferred low cost crystalline polyesters are poly(1,9-nonylene-1,12-dodecanoate), poly(1,6-hexylene-1,12-dodecanoate) and poly(1,6-hexylene-1,10-decanoate).

In embodiments, the amorphous polyester resin is present in the toner particle core in an amount of from about 20 to about 80, or from about 20 to about 70, or from about 30 to about 65 percent by weight of the total weight of the core. Such amorphous polyester resins are selected from the group consisting of poly(alkoxylated bisphenol-A co-fumarate-co-terephthalate-cododecenylsuccinate), and mixtures thereof. In embodiments, as noted above, an unsaturated amorphous polyester resin may be utilized as a latex resin. In embodiments embodiment, the amorphous polyester resin can be obtained from Kao corporation as FXC42 and FXC56. Examples of such resins include those disclosed in U.S. Pat. No. 6,063,827 and No. 8,466,254, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), poly(co-propoxylated bisphenol co-ethoxylated bisphenol co-fumarate-coterephthalate-co-dodecenysuccinate) and combinations thereof.

The emulsion aggregation toner of the present embodiments has a minimum fusing temperature (MFT) of from about 90 to about 150, or from about 100 to about 130, or from about 100 to about 125. This is about from about 15 to about 20 lower than other emulsion aggregation toners without polyester in the core or shell. The present embodiments also have acceptable dielectric loss of from about 10 to about 40, or from about 20 to about 40, or from about 20 to about 35. From previous studies, the present inventors discovered that the dielectric loss of toners can be improved by increased shell thickness and decreasing the coalescence temperature. As such, the present toner composition has a preferable shell percentage of from about 28 to about 40, or from about 30 to about 38, or from about 30 to about 36 percent of the toner particles. In making these toner compositions, the coalescence temperature used is preferably of from about 70 to about 90° C., or from about 70 to about 80° C., or from about 70 to about 77° C. In particular embodiments, the latex particle size used in making these toner compositions is of from about 100 nm to 159 nm. The present inventors also discovered that lowering the coalescence temperature and using smaller latex particle sizes help prevent any phase separation of the styrene-acrylate resin from the polyester resins and keep the styrene-acrylate in the core rather than migrating to the surface. In this manner, good electrical and fusing properties are maintained.

Latex Resin

In embodiments, a developer is disclosed including a resin coated carrier and a toner, where the toner may be an emulsion aggregation toner, containing, but not limited to, a latex resin, a wax and a polymer shell.

Generally, the latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vice versa. In case a mixture of monomers is used, typically the latex polymer will be a copolymer. As discussed above, the latex resin is composed of at least styrene acrylate, a polyester resin and a crystalline resin.

Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

In some embodiments, the first monomer composition and the second monomer composition may independently of each other comprise two or three or more different monomers. (side note—sounds very similar to my entry above) The latex polymer therefore can comprise a copolymer. Illustrative examples of such a latex copolymer includes poly(styrene-n-butyl acrylate-β-CEA), poly(styrene-alkyl acrylate), poly (styrene-1,3-diene), poly(styrene-alkyl methacrylate), poly (alkyl methacrylate-alkyl acrylate), poly(alkyl methacrylate-aryl acrylate), poly(aryl methacrylate-alkyl acrylate), poly (alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, 1,12-dodecanoic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent.

The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin. Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl) propane, and polyoxypropylene (6)-2,2-bis(4-hydroxyphenyl) propane. These compounds may be used singly or as a combination of two or more thereof.

Examples of additional diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Furthermore, in embodiments, a crystalline polyester resin may be contained in the binding resin. The crystalline polyester resin may be synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

As the acid-derived component, an aliphatic dicarboxylic acid may be utilized, such as a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as lower alkyl esters and acid anhydrides thereof. Among these, acids having 6 to 10 carbon atoms may be desirable for obtaining suitable crystal melting point and charging properties. In order to improve the crystallinity, the straight chain carboxylic acid may be present in an amount of about 95% by mole or more of the acid component and, in embodiments, more than about 98% by mole of the acid component. Other acids are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof, as well as combinations thereof, and the like.

As the alcohol component, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having from about 6 to about 10 carbon atoms may be used to obtain desirable crystal melting points and charging properties. In order to raise crystallinity, it may be useful to use the straight chain dialcohols in an amount of about 95% by mole or more, in embodiments about 98% by mole or more.

Examples of other dihydric dialcohols which may be utilized include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol, neopentyl glycol, combinations thereof, and the like.

For adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane, pentaerythritol, combinations thereof, and the like.

The crystalline polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, may be used in excess.

Surfactants

Any suitable surfactants may be used for the preparation of the latex and wax dispersions according to the present disclosure. Depending on the emulsion system, any desired nonionic or ionic surfactant such as anionic or cationic surfactant may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890®, and ANTAROX 897®) and the like, as well as mixtures thereof.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl-1,4-dipheny-1-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP604™ and NP608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In embodiments, toner compositions may be prepared by emulsion-aggregation processes, such as, a process that includes aggregating a mixture of an optional wax and any other desired or required additives, and emulsions including the resins described above, optionally with surfactants, as described above, and then coalescing the aggregate mixture. A mixture may be prepared by adding an optional wax or other materials, which optionally also may be in a dispersion(s) including a surfactant, to the emulsion, which may be a mixture of two or more emulsions containing the resin. The pH of the resulting mixture may be adjusted by an acid (i.e., a pH adjustor) such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer or a Gaulin 15MR homgenizer.

Following preparation of the above mixture, generally, an aggregating agent may be added to the mixture. Suitable aggregating agents include, for example, aqueous solutions of a divalent cation or a multivalent cation material. In the present embodiments, a polyaluminum halide, specifically, polyaluminum chloride (PAC) is used. PAC is a stronger multivalent flocculant as compared to aluminum sulfate, which is a bivalent flocculant. It was discovered that the PAC unexpectedly improves the surface morphology by reducing the amount of styrene-acrylate on the surface. It is believed that the multivalent PAC helps bind and keep the higher acid value styrene-acrylate latex to the core of the toner particles.

In using the PAC, the manufacturing process is modified to lengthen the coalescence time (as compared to that used with conventional flocculants like aluminum sulfate) to from about 1 hour to about 3 hours, or from about 1.5 hours to about 2.5 hours. It was discovered that this modification of longer coalescence time is needed to smooth the toner surface and obtain optimal surface morphology.

Other aggregating agents that may be used include the corresponding bromide, fluoride or iodide, and combinations thereof. In embodiments, the aggregating agent is present in the toner composition in an amount of from about 0.1 to about 1.0 percent, or of from about 0.2 to about 0.8 percent, or of from about 0.25 to about 0.5 percent by weight of the total weight of the toner particles. In embodiments, the aggregating agent may be added to the mixture at a temperature that is below the glass transition temperature ($T_g$) of the resin. As discussed above, the reduced coalescence temperature used is from about 70 to about 90° C., or from about 70 to about 80° C., or from about 70 to about 77° C.

The aggregating agent may be added to the mixture to form a toner in an amount of, for example, from about 0.1 parts per hundred (pph) to about 1 pph of the toner particles, in embodiments, from about 0.25 pph to about 0.75 pph of the toner particles.

The gloss of a toner may be influenced by the amount of retained metal ion, such as, $Al^{3+}$, in the particle. The amount of retained metal ion may be adjusted further by the addition of ethylene diamine tetraacetic acid (EDTA). In embodiments, the amount of retained metal ion, for example, $Al^{3+}$, in toner particles of the present disclosure may be from about 0.1 pph to about 1 pph, in embodiments, from about 0.25 pph to about 0.8 pph.

The disclosure also provides a melt mixing process to produce low cost and safe cross-linked thermoplastic binder resins for toner compositions which have, for example, low fix temperature and/or high offset temperature, and which may show minimized or substantially no vinyl offset. In the process, unsaturated base polyester resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By, "highly cross-linked," is meant that the polymer involved is substantially cross-linked, that is, equal to or above the gel point. As used herein, "gel point," means the point where the polymer is no longer soluble in solution (see, e.g., U.S. Pat. No. 4,457,998, herein incorporated by reference in entirety).

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the $T_g$ of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 65° C., and holding the mixture at that temperature for a time from about 0.5 hr to about 6 hr, in embodiments, from about 1 hr to about 5 hr, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 6.0 μm, about 6.0 to about 6.5 μm, about 6.5 to about 7.0 μm, about 7.0 to about 7.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 00° C., in embodiments, from about 45° C. to about 80° C., which may be below the $T_g$ of the resin.

Following aggregation to the desired particle size, with the optional formation of a shell as described above, the particles then may be coalesced to the desired final shape, the coalescence being achieved by, for example, heating the mixture to a temperature of from about 55° C. to about 100° C., in embodiments from about 65° C. to about 75° C., which may be below the melting point of a crystalline resin to prevent plasticization. Higher or lower temperatures may be used, it being understood that the temperature is a function of the resins used.

Coalescence may proceed over a period of from about 0.1 to about 9 hr, in embodiments, from about 0.5 to about 4 hr.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

Toners may possess favorable charging characteristics when exposed to extreme RH conditions. The low humidity zone (C zone) may be about 12° C./15% RH, while the high humidity zone (A zone) may be about 28° C./85% RH. Toners of the disclosure may possess a parent toner charge per mass ratio (Q/M) of from about −5 μC/g to about −80 μC/g, in embodiments, from about −10 μC/g to about −70 μC/g, and a final toner charging after surface additive blending of from −15 μC/g to about −60 μC/g, in embodiments, from about −20 μC/g to about −55 μC/g.

Shell Resin

In embodiments, a shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described herein. The aggregated particles described above may be combined with said emulsion so that the resin forms a shell over the formed aggregates. In embodiments, an amorphous polyester may be utilized to form a shell over the aggregates to form toner particles having a core-shell configuration.

Toner particles can have a size of diameter of from about 4 to about 8 μm, in embodiments, from about 5 to about 7 μm, the optimal shell component may be about 26 to about 30% by weight of the toner particles.

Alternatively, a thicker shell may be desirable to provide desirable charging characteristics due to the higher surface area of the toner particle. Thus, the shell resin may be present in an amount from about 30% to about 40% by weight of the toner particles, in embodiments, from about 32% to about 38% by weight of the toner particles, in embodiments, from about 34% to about 36% by weight of the toner particles.

In embodiments, a photoinitiator may be included in the shell. Thus, the photoinitiator may be in the core, the shell, or both. The photoinitiator may be present in an amount of from about 1% to about 5% by weight of the toner particles, in embodiments, from about 2% to about 4% by weight of the toner particles.

Emulsions may have a solids loading of from about 5% solids by weight to about 20% solids by weight, in embodiments, from about 12% solids by weight to about 17% solids by weight.

Once the desired final size of the toner particles is achieved, the pH of the mixture may be adjusted with a base (i.e., a pH adjustor) to a value of from about 6 to about 10, and in embodiments from about 6.2 to about 7. The adjustment of the pH may be utilized to freeze, that is to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, EDTA may be added to help adjust the pH to the desired values noted above. The base may be added in amounts from about 2 to about 25% by weight of the mixture, in embodiments, from about 4 to about 10% by weight of the mixture. In embodiments, the shell has a higher $T_g$ than the aggregated toner particles.

Carriers

Various suitable solid core or particle materials can be utilized for the carriers and developers of the present disclosure. Characteristic particle properties include those that, in embodiments, will enable the toner particles to acquire a positive charge or a negative charge, and carrier cores that provide desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier particles or cores that can be utilized include iron and/or steel, such as, atomized iron or steel powders available from Hoeganaes Corporation or Pomaton S.p.A (Italy); ferrites, such as, Cu/Zn-ferrite containing, for example, about 11% copper oxide, about 19% zinc oxide, and about 70% iron oxide, including those commercially available from D.M. Steward Corporation or Powdertech Corporation, Ni/Zn-ferrite available from Powdertech Corporation, Sr (strontium)-ferrite, containing, for example, about 14% strontium oxide and about 86% iron oxide, commercially available from Powdertech Corporation, and Ba-ferrite; magnetites, including those commercially available from, for example, Hoeganaes Corporation (Sweden); nickel; combinations thereof, and the like. In embodiments, the polymer particles obtained can be used to coat carrier cores of any known type by various known methods, and which carriers then are incorporated with a known toner to form a developer for electrophotographic printing. Other suitable carrier cores are illustrated in, for example, U.S. Pat. Nos. 4,937,166, 4,935,326 and 7,014,971, the disclosure of each of which hereby is incorporated by reference in entirety, and may include granular zircon, granular silicon, glass, silicon dioxide, combinations thereof, and the like. In embodiments, suitable carrier cores may have an average particle size of, for example, from about 20 μm to about 400 μm in diameter, in embodiments, from about 40 μm to about 200 μm in diameter.

In embodiments, a ferrite may be utilized as the core, including a metal, such as, iron and at least one additional metal, such as, copper, zinc, nickel, manganese, magnesium, calcium, lithium, strontium, zirconium, titanium, tantalum, bismuth, sodium, potassium, rubidium, cesium, strontium, barium, yttrium, lanthanum, hafnium, vanadium, niobium, aluminum, gallium, silicon, germamium, antimony, combinations thereof and the like.

In some embodiments, the carrier coating may include a conductive component. Suitable conductive components include, for example, carbon black.

There may be added to the carrier a number of additives, for example, charge enhancing additives, including particulate amine resins, such as, melamine, and certain fluoropolymer powders, such as alkyl-amino acrylates and methacrylates, polyamides, and fluorinated polymers, such as polyvinylidine fluoride and poly(tetrafluoroethylene) and fluoroalkyl methacrylates, such as 2,2,2-trifluoroethyl methacrylate. Other charge enhancing additives which may be utilized include quaternary ammonium salts, including distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, combinations thereof, and the like, and other effective known charge agents or additives. The charge additive components may be selected in various effective amounts, such as from about 0.5 wt % to about 20 wt %, from about 1 wt % to about 3 wt %, based, for example, on the sum of the weights of polymer/copolymer, conductive component, and other charge additive components. The addition of conductive components can act to further increase the negative triboelectric charge imparted to the carrier, and therefore, further increase the negative triboelectric charge imparted to the toner in, for example, an electrophotographic development subsystem. The components may be included by roll mixing, tumbling, milling, shaking, electrostatic powder cloud spraying, fluidized bed, electrostatic disc processing, and an electrostatic curtain, as described, for example, in U.S. Pat. No. 6,042,981, the disclosure of which hereby is incorporated by reference in entirety, and wherein the carrier coating is fused to the carrier core in either a rotary kiln or by passing through a heated extruder apparatus.

Conductivity can be important for semiconductive magnetic brush development to enable good development of solid areas which otherwise may be weakly developed. Addition of a polymeric coating of the present disclosure, optionally with a conductive component such as carbon black, can result in carriers with decreased developer triboelectric response with change in relative humidity of from about 20% to about 90%, in embodiments, from about 40% to about 80%, that the charge is more consistent when the relative humidity is changed. Thus, there is less decrease in charge at high relative humidity reducing background toner on the prints, and less increase in charge and subsequently less loss of development at low relative humidity, resulting in such improved image quality performance due to improved optical density.

As noted above, in embodiments the polymeric coating may be dried, after which time it may be applied to the core carrier as a dry powder. Powder coating processes differ from conventional solution coating processes. Solution coating requires a coating polymer whose composition and molecular weight properties enable the resin to be soluble in a solvent in the coating process. That requires relatively low $M_w$ components as compared to powder coating. The powder coating process does not require solvent solubility, but does require the resin coated as a particulate with a particle size of from about 10 nm to about 2 μm, in embodiments, from about 30 nm to about 1 μm, in embodiments, from about 50 nm to about 500 nm.

Examples of processes which may be utilized to apply the powder coating include, for example, combining the carrier core material and resin coating by cascade roll mixing, tumbling, milling, shaking, electrostatic powder cloud spraying, fluidized bed, electrostatic disc processing, electrostatic curtains, combinations thereof and the like. When resin coated carrier particles are prepared by a powder coating process, the majority of the coating materials may be fused to the carrier surface, thereby reducing the number of toner impaction sites on the carrier. Fusing of the polymeric coating may occur by mechanical impaction, electrostatic attraction, combinations thereof and the like.

Following application of the resin to the core, heating may be initiated to permit flow of the coating material over the surface of the carrier core. The concentration of the coating material, in embodiments, powder particles, and the parameters of the heating may be selected to enable the formation of a continuous film of the coating polymers on the surface of the carrier core, or permit only selected areas of the carrier core to be coated. In embodiments, the carrier with the polymeric powder coating may be heated to a temperature of from about 170° C. to about 280° C., in embodiments from about 190° C. to about 240° C., for a period of time of, for example, from about 10 min to about 180 min, in embodiments, from about 15 min to about 60 min, to enable the polymer coating to melt and to fuse to the carrier core particles. Following incorporation of the powder on the surface of the carrier, heating may be initiated to permit flow of the coating material over the surface of the carrier core. In embodiments, the powder may be fused to the carrier core in either a rotary kiln or by passing through a heated extruder apparatus, see, for example, U.S. Pat. No. 6,355,391, the disclosure of which hereby is incorporated by reference in entirety.

In embodiments, the coating coverage encompasses from about 10% to about 100% of the carrier core. When selected areas of the metal carrier core remain uncoated or exposed, the carrier particles may possess electrically conductive properties when the core material is a metal.

The coated carrier particles may then be cooled, in embodiments to room temperature, and recovered for use in forming developer.

In embodiments, carriers of the present disclosure may include a core, in embodiments, a ferrite core, having a size of from about 20 μm to about 100 μm, in embodiments, from about 30 μm to about 75 μm, coated with from about 0.5% to about 10% by weight, in embodiments, from about 0.7% to about 5% by weight, of the polymer coating of the present disclosure, optionally including carbon black.

Thus, with the carrier compositions and processes of the present disclosure, there can be formulated developers with selected high triboelectric charging characteristics and/or conductivity values utilizing a number of different combinations.

Developers

The toner particles thus formed may be formulated into a developer composition. The toner particles may be mixed with carrier particles to achieve a two component developer composition. The toner concentration in the developer may be from about 1% to about 25% by weight of the total weight of the developer, in embodiments, from about 2% to about 15% by weight of the total weight of the developer.

Imaging

The toners can be utilized for electrophotographic processes, including those disclosed in U.S. Pat. No. 4,295,990, the disclosure of which is hereby incorporated by reference in entirety. In embodiments, any known type of image development system may be used in an image developing device, including, for example, magnetic brush development, hybrid scavengeless development (HSD) and the like. Those and similar development systems are within the purview of those skilled in the art.

It is envisioned that the toners of the present disclosure may be used in any suitable procedure for forming an image with a toner, including in applications other than xerographic applications.

Utilizing the toners of the present disclosure, images may be formed on substrates, including flexible substrates, having a toner pile height of from about 1 μm to about 6 μm, in embodiments, from about 2 μm to about 4.5 μm, in embodiments, from about 2.5 to about 4.2 μm.

In embodiments, the toner of the present disclosure may be used for a xerographic print protective composition that provides overprint coating properties including, but not limited to, thermal and light stability and smear resistance, particularly in commercial print applications. More specifically, such overprint coating as envisioned has the ability to permit overwriting, reduce or prevent thermal cracking, improve fusing, reduce or prevent document offset, improve print performance and protect an image from sun, heat and the like. In embodiments, the overprint compositions may be used to improve the overall appearance of xerographic prints due to the ability of the compositions to fill in the roughness of xerographic substrates and toners, thereby forming a level film and enhancing glossiness.

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

The examples set forth herein below are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Control

Control Toner Example 1

Preparation of 22% Styrene-Acrylate Core (Latex Particle Size 162 nm) Black Toner Particle at 70° C.

In a 2 L reactor, 43 g of amorphous polyester emulsion (FXC42 available from Kao Corporation), 47 g of amorphous polyester emulsion (FXC56 available from Kao Corporation), 81 g styrene-acrylate latex (comprised of 23.5% n-butylacrylate, 76.5% styrene with an average molecular weight of 55,000 g/mole, particle size 162 nm), 29 g crystalline polyester emulsion, 43 g wax, 9.6 g cyan pigment, 57 g black pigment (Nipex-35), 0.7 g surfactant (Dowfax) and 534 g de-ionized water (DI) water are combined. Then 2.7 g of aluminum sulphate ($Al_2(SO_4)_3$) mixed with 33 g DI water is added to the slurry under homogenization at 3000-4000 RPM. The reactor is set to 260 RPM and is heated to 42 C to aggregate the toner particles. When the size reaches 4.8-5 μm, a shell coating is added which consists of 69 g of amorphous polyester emulsion (FXC42), 74 g of amorphous polyester emulsion (FXC56) with 1.15 g surfactant (Dowfax) and all ph adjusted to 3.3 using 0.3M nitric acid. The reaction is further heated to 50 C. When the toner particle size reaches 5.6-6 microns, freezing begins with the pH of the slurry being adjusted to 4.5 using a 4% NaOH solution. The reactor RPM is decreased to 220 followed by the addition of 5.77 grams of a chelating agent (Versene100) and more NaOH solution until pH reaches 7.8. The reactor temperature is ramped to 70 C. The pH of the slurry is maintained at 7.8 or greater until 70 C. Once at the coalescence temperature, the slurry pH is reduced to 6.0 using pH 5.7 Buffer and is coalesced for about 1 hour until the particle circularity is between 0.955-0.960 as measured by the Flow Particle Image Analysis (FPIA) instrument. The slurry is then quench cooled in 770 g DI ice. The final particle size was 5.90 microns, GSDv 1.21, GSDn 1.22 and a circularity of 0.958. The toner is then washed and freeze-dried.

Example 1

Toner Example 1

Preparation of Hybrid Black Toner Particle with Al2(SO4)3

In a 2 L reactor, 43 g of amorphous polyester emulsion ( ), 47 g of amorphous polyester emulsion (FXC56), 82 g styrene-acrylate latex (comprised of 23.5% n-butylacrylate, 76.5% styrene with an average molecular weight of 55,000 g/mole, particle size 162 nm, particle size 141 nm), 29 g crystalline polyester emulsion, 43 g wax, 9.6 g cyan pigment, 57 g black pigment (Nipex-35), 0.7 g surfactant (Dowfax) and 534 g DI water are combined. Then 2.7 g of aluminum sulphate ($Al_2(SO_4)_3$) mixed with 33 g DI water is added to the slurry under homogenization at 3000-4000 RPM. The reactor is set to 260 RPM and is heated to 42 C to aggregate the toner particles. When the size reaches 4.8-5 μm, a shell coating is added which consists of 69 g of amorphous polyester emulsion (FXC42), 74 g of amorphous polyester emulsion (FXC56) with 1.15 g surfactant (Dowfax) and all pH adjusted to 3.3 using 0.3M nitric acid. The reaction is further heated to 50 C. When the toner particle size reaches 5.6-6 microns, freezing begins with the pH of the slurry being adjusted to 4.5 using a 4% NaOH solution. The reactor RPM is decreased to 220 followed by the addition of 5.77 grams of a chelating agent (Versene100) and more NaOH solution until pH reaches 7.8. The reactor temperature is ramped to 70 C. The pH of the slurry is maintained at 7.8 or greater until 70 C. Once at the coalescence temperature, the slurry pH is reduced to 6.0 using pH 5.7 Buffer and is coalesced for about 1 hour until the particle circularity is between 0.955-0.960 as measured by the Flow Particle Image Analysis (FPIA) instrument. The slurry is then quench cooled in 770 g DI ice. The final particle size was 6.0 microns, GSDv 1.21, GSDn 1.24 and a circularity of 0.955. The toner is then washed and freeze-dried.

Example 2

Toner Example 2

Preparation of Hybrid Black Toner Particle with PAC

In a 2 L reactor, 43 g of amorphous polyester emulsion (FXC42), 47 g of amorphous polyester emulsion (FXC56), 82 g styrene-acrylate latex (comprised of 23.5% n-butylacrylate, 76.5% styrene with an average molecular weight of 55,000 g/mole, particle size 141 nm, particle size 141 nm), 29 g crystalline polyester emulsion, 43 g wax, 9.6 g cyan pigment, 57 g black pigment (Nipex-35), 0.7 g surfactant (Dowfax) and 534 g DI water are combined. Then 2.7 g of polyaluminum chloride (PAC) mixed with 24 g 0.02M nitric acid is added to the slurry under homogenization at 3000-4000 RPM. The reactor is set to 260 RPM and is heated to 42 C to aggregate the toner particles. When the size reaches 4.8-5 μm, a shell coating is added which consists of 69 g of amorphous polyester emulsion (FXC42), 74 g of amorphous polyester emulsion (FXC56) with 1.15 g surfactant (Dowfax) and all pH adjusted to 3.3 using 0.3M nitric acid. The reaction is further heated to 50 C. When the toner particle size reaches 5.6-6 microns, freezing begins with the pH of the slurry being adjusted to 4.5 using a 4% NaOH solution. The reactor RPM is decreased to 220 followed by the addition of 5.77 grams of a chelating agent (Versene100) and more NaOH solution until pH reaches 7.8. The reactor temperature is ramped to 70 C. The pH of the slurry is maintained at 7.8 or greater until 70 C. Once at the coalescence temperature, the slurry pH is reduced to 6.0 using pH 5.7 Buffer and is coalesced for about 2 hour until the particle circularity is between 0.955-0.960 as measured by the Flow Particle Image Analysis (FPIA) instrument. The slurry is then quench cooled in 770 g DI ice. The final particle size was 6.3 microns, GSDv 1.23, GSDn 1.25 and a circularity of 0.955. The toner is then washed and freeze-dried.

Comparative Examples

Xerox 700 Toner (Cyan or Black)

This commercially available toner was used as comparison to the inventive toners. The Xerox 700 Toner is comprised of an emulsion aggregation toner, wherein the core is comprised of about 6 to 7 percent by weight of crystalline resin, 5 to 6 percent by weight of Cyan or Black pigment, 8 to 10 percent by weight of Wax, and about 50 to about 52 percent by weight of amorphous polyester resin, and wherein the shell is from about 28 percent by weight of toner Xerox Docucolor 2240 Cyan Toner This commercially available toner was used as comparison to the inventive toners. The Xerox Docucolor 2240 Toner is comprised of an emulsion aggregation toner, wherein the core is comprised of 5 to 6 percent by weight of Cyan or Black pigment, 10-12 percent by weight of Wax, and about 54 to about 56 percent by weight of Styrene-acrylate resin, and wherein the shell is a styrene-acrylate resin of from about 28 percent by weight of toner.

Table 1 shows the features and properties of the Control, Toner Examples 1 and 2 as well as an emulsion aggregate polyester-based toner (Xerox 700 Toner). The Control and Toner Examples 1 and 2 all incorporate at least 20% styrene-acrylate latex. Toner Example 2 has PAC as the flocculant.

TABLE 1

| TONER ID | Xerox 700 Toner | Control | Toner Example 1 | Toner Example 2 |
|---|---|---|---|---|
| Core latex | 50% amorphous polyester 7% crystalline polyester | 22% amorphous polyester 22% sty-acrylate (large latex size: 161 nm) 7% crystalline polyester | 22% amorphous polyester 22% sty-acrylate (small latex size: 141 nm) 7% crystalline polyester | 22% amorphous polyester 22% sty-acrylate (small latex size: 141 nm) 7% crystalline polyester |
| Shell latex | 28% amorphous polyester | 34% amorphous polyester | 34% amorphous polyester | 34% amorphous polyester |
| Coal. Temp (° C.) | 85 | 70 | 70 | 70 |
| Flocculant | $Al_2(SO_4)_3$ | $Al_2(SO_4)_3$ | $Al_2(SO_4)_3$ | PAC |
| D50 | | 5.90 | 6.0 | 6.3 |
| GSDv/n | | 1.21/1.22 | 1.21/1.24 | 1.23/1.25 |
| Circularity | | 0.958 | 0.955 | 0.955 |

Figure 1B:
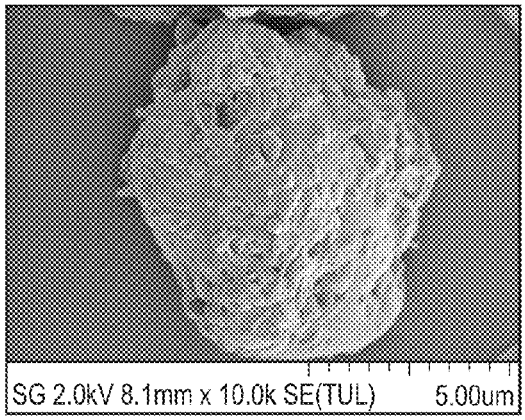
FIG. 1B provides SEM images of a hybrid toner made according to the present embodiments.
Figure 1C:
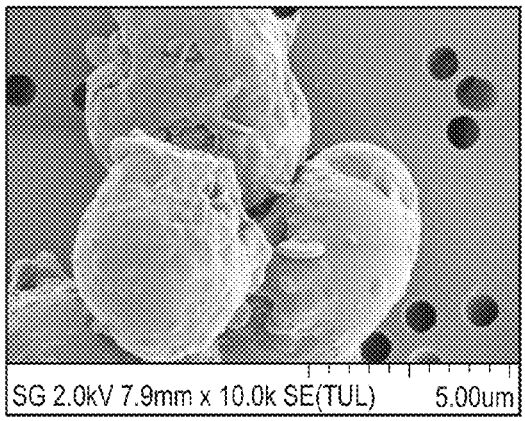
FIG. 1C provides SEM images of another hybrid toner made according to the present embodiments.

SEM images were taken of the Control and Toner Examples 1 and 2, as shown in FIG. 1. As can be seen from FIG. 1, the surface does improve with smaller size polystyrene/acrylate latex (the Control as compared to Toner Example 1) and an even larger improvement is seen when the flocculant is changed to PAC (Toner Example 2).

These toners were then analyzed for charging and fusing performance, the results are below.

Developer Performance Results

Charging performance is comparable to the standard EA polyester toner, however, the main concern is the blocking onset and % heat cohesion. These two properties are not as good as the Polyester Control Toner, however, after some investigation it was noticed that the surface morphology of the toners were worse than the Polyester Control Toner. As seen in the toner SEM images, the toner surface contained a lot of polystyrene/acrylate latex and some wax particles. The wax content is typical; however, the polystyrene/acrylate on the surface prevents the toner additives from properly covering the toner surface and as well negatively impacts the toner performance. Surprisingly, when the flocculant was switched to PAC to flocculate the toner, it can be seen that the toner surface improves. The polystyrene/acrylate latex does not protrude to the surface of the toner, but rather remains more in the center of the toner.

TABLE 2

Sample conditioned in J-Zone for 24 hours. Capacitance and loss factor measured at 100 KHz and 1VAC.

| | E' (dielectric constant) | E" * 1000 (loss) |
|---|---|---|
| Xerox 700 Toner | 3.61 | 36 |
| Control | 3.10 | 34 |
| Toner Example 1 | 3.40 | 36 |
| Toner Example 2 | 3.08 | 27 |

As can be seen from the above Table 2, the toner dielectric loss remains comparable to the Polyester Control Toner if not even improves with the improved surface morphology.

Table 3 below shows the toner blocking results for the various hybrid examples.

TABLE 3

| | Blocking Onset |
|---|---|
| Xerox 700 Toner (Black) | 53 C |
| KN749K | <51 C |
| KN754K | 51 C |
| KN758K | 52 C |

The blocking for Toner Example 2 is within experimental error of the Polyester Control Toner (Xerox 700 Toner); whereas the previous two samples (the Control and Toner Example 1) have noticeable shortfalls.

Figure 2:
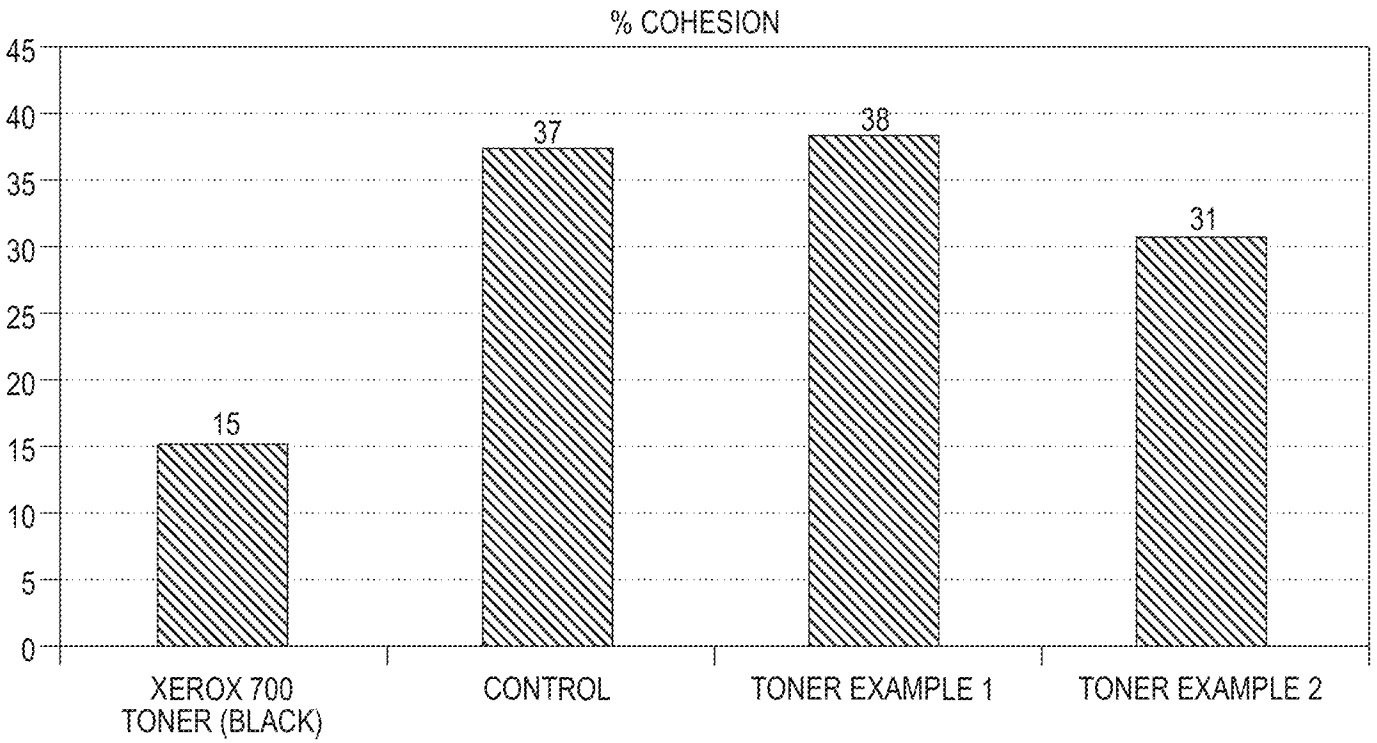
FIG. 2 is a graph illustrating the improved % heat cohesion of the toner made according to the present embodiments as compared to control toners.

FIG. 2 shows how the % heat cohesion of the toner of the present embodiments is also improved as compared to the Control and Toner Example 1, without PAC as the flocculant.

Summary of Fusing Results

Gloss, crease and hot offset data of particles was collected with samples fused onto Color Xpressions Select (90 gsm) using an in-house fusing fixture. The toners were within experimental uncertainty of the Polyester Control Toner reference samples.

The Control

Print gloss curve of this hybrid toner was between the Xerox 700 Toner, Xerox Docucolor 2240 comparative reference samples and has a lower peak gloss (57 gu versus 63 gu). The temperature needed to reach 50 gloss units is 158° C. while the Xerox Docucolor 2240 toner required 166° C. and the Polyester Control Toner required 146° C.

Crease fix minimum fix temperature (MFT) of this hybrid toner was lower than the Xerox 700 Toner (117° C. versus 123° C.) and much lower than the Xerox Docucolor 2240 toner (117° C. versus 143° C.). Lab scale and bench scale particles can have crease fix MFT's less than production scale particles.

There was no toner hot offset to the fuser roll at 210° C. resulting in wide fusing latitude.

Toner Example 1 and 2

Print gloss of this hybrid toner is approaching the design gloss and bench scale polyester toner and crease fix MFT is lower than production polyester toner MFT. Both hybrid toners had a very low crease fix MFT and gloss curve approaching the polyester toner gloss curve. The lower coalescence curve and small styrene acrylate latex particles did not significantly impact the fusing performance of the hybrid design.

Fusing results were consistent with the previous hybrid particles.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

What is claimed is:

1. A toner composition comprising:

toner particles having a core, wherein the core comprises a resin, a colorant, a wax, and polyaluminum chloride, wherein the resin comprises a styrene-acrylate resin present in the core in an amount of from about 10 to about 35 percent by weight of the total weight of the core, a crystalline polyester resin present in the core in an amount of from about 3 to about 10 percent by weight of the total weight of the core and an amorphous polyester resin present in the core in an amount of from about 20 to about 30 percent by weight of the total weight of the core; and a shell disposed over the core, further wherein an emulsion of the styrene-acrylate resin used in the core has a particle size of from about 100 nm to about 141 nm.

2. The toner composition of claim 1, wherein the aggregating agent is present in the toner composition in an amount of from about 0.1 to about 1.0 percent by weight of the total weight of the toner particles.

3. The toner composition of claim 1, wherein the amorphous polyester resin is selected from the group consisting poly(alkoxylated bisphenol-A co-fumarate-co-terephthalate-cododecenylsuccinate), poly(propoxylated bisphenol co-fumarate), poly(ethoxylated bisphenol co-fumarate), and mixtures thereof.

4. The toner composition of claim 1, wherein shell comprises an amorphous polyester resin.

5. The toner composition of claim 1, wherein the shell comprises from about 30 to about 36 percent by weight of the toner composition.

6. The toner composition of claim 1 having a minimum fusing temperature of from about 100 to about 130° C.

7. The toner composition of claim 1 having a dielectric loss of from about 20 to about 40.

8. The toner composition of claim 1 being an emulsion aggregation toner.

9. A developer comprising:

a toner composition; and a toner carrier, wherein the toner composition comprises toner particles having a core, wherein the core comprises a resin, a colorant, a wax, and polyaluminum chloride, wherein the resin comprises a styrene-acrylate resin present in the core in an amount of from about 10 to about 35 percent by weight of the total weight of the core, a crystalline polyester resin present in the core in an amount of from about 3 to about 10 percent by weight of the total weight of the core and an amorphous polyester resin present in the core in an amount of from about 20 to about 30 percent by weight of the total weight of the core; and a shell disposed over the core, further wherein an emulsion of the styrene-acrylate resin used in the core has a particle size of from about 100 nm to about 141 nm.

10. The developer of claim 9, wherein the aggregating agent is present in the toner composition in an amount of from about 0.1 to about 1.0 percent by weight of the total weight of the toner particles.

11. A method of making a toner comprising mixing together and emulsifying a resin, a colorant, and a wax, wherein the resin comprises a combination of a styrene-acrylate resin, a crystalline polyester resin and an amorphous polyester resin to form a latex emulsion, wherein an emulsion of the styrene-acrylate resin has a particle size of from about 100 nm to about 141 nm;

adding polyaluminum chloride to the latex emulsion;

aggregating the latex emulsion to form toner particle cores, wherein the toner particle cores comprise the styrene-acrylate resin present in the core in an amount of from about 10 to about 35 percent by weight of the total weight of the core, the crystalline polyester resin present in the core in an amount of from about 3 to about 10 percent by weight of the total weight of the core and the amorphous polyester resin present in the core in an amount of from about 20 to about 30 percent by weight of the total weight of the core;

forming a shell over the toner particle cores to form toner particles;

coalescing the toner particles; and cooling the toner particles.

12. The method of claim 11, wherein the polyaluminum chloride is added to the latex emulsion at a temperature that is below the glass transition temperature ($T_g$) of the styrene-acrylate resin and crystalline polyester resin.

13. The method of claim 11, wherein the toner particles are coalesced at a reduced temperature of from about 70 to about 90° C.

14. The method of claim 11, wherein the polyaluminum chloride is added to the latex emulsion in an amount of from about 0.1 parts per hundred to about 1 parts per hundred of the toner particles.

15. The method of claim 11, wherein the latex emulsion has a particle size of from about 100 to about 159.

16. The method of claim 15, wherein the latex emulsion has a particle size of from about 100 to about 140.

17. The method of claim 11, wherein the coalescing step takes from about 1 hour to about 3 hours.

* * * * *